US005654728A

United States Patent [19]

Kanazawa et al.

[11] Patent Number: 5,654,728

[45] Date of Patent: Aug. 5, 1997

[54] AC PLASMA DISPLAY UNIT AND ITS DEVICE CIRCUIT

[75] Inventors: Yoshikazu Kanazawa; Tomokatsu Kishi, both of Kawasaki, Japan

[73] Assignee: Fujitsu Limited, Kawasaki, Japan

[21] Appl. No.: 661,024

[22] Filed: Jun. 10, 1996

[30] Foreign Application Priority Data

Oct. 2, 1995 [JP] Japan ..... 7-255381

[51] Int. Cl.[6] ..... G09G 3/28

[52] U.S. Cl. ..... 345/68; 345/204; 326/119; 326/133; 315/169.4

[58] Field of Search ..... 345/60, 61, 62, 345/204, 67, 68, 74, 76; 315/167, 169.3, 169.4; 313/231.31, 231.41; 326/95, 98, 119, 133

[56] References Cited

U.S. PATENT DOCUMENTS 4,900,987 2/1990 Otsuka et al. ..... 345/60

5,003,228 3/1991 Hada et al. ..... 345/60

5,420,602 5/1995 Kanazawa ..... 345/67

5,424,612 6/1995 Kim ..... 345/61

*Primary Examiner*—Richard Hjerpe

*Assistant Examiner*—Lun-Yi Lao

*Attorney, Agent, or Firm*—Staas & Halsey

[57] ABSTRACT

A separating circuit 244 is connected between a scanning voltage circuit 241, which supplies a selected voltage V1 to a line SU and an unselected voltage V2 to a line SD, and a sustaining voltage circuit 242, which selectively supplies a sustaining voltage Vs and 0 V to a line SC. A power recovery circuit 243 is connected to the line SC. In the separating circuit 244, a switch SW16 is connected between the line SD and the line SC and line SC, and a switch SW17 is connected between the line SU and the line SC. During an address period, the switches SW16 and SW17 are turned off and during a sustain period the switch SW16 is turned on/off and SW17 is turned on. The switch SW16 is constituted with a diode whereas the switch SW17 is constituted with a MOS transistor. When the unselected voltage V2 is negative, either the switch SW16 or SW17 may be omitted.

14 Claims, 11 Drawing Sheets

AC PLASMA DISPLAY UNIT AND ITS DEVICE CIRCUIT

BACKGROUND OF THE INVENTION

1. Field of the Invention

The present invention relates to an AC plasma display unit and its drive circuit.

2. Description of the Related Art

FIG. 7 shows the structure of a cross section of a pixel 10 in a three-electrode surface-discharge AC plasma display panel (PDP).

A pair of electrodes X1 and Y1 extending in a direction vertical to the paper surface are formed on a glass substrate 11, with a dielectric layer 12 covering it, and an MgO protective film 13 further covering that. An address electrode A1 extending in the left/right direction on the paper surface is formed on a glass substrate 14 which is provided facing opposite the glass substrate 11, with a phosphor 15 covering it. A discharge space 17 located between the MgO protective film 13 and the phosphor 15 is charged with, for instance, Ne+Xe Penning mixed gas.

FIG. 6 shows a schematic structure of a plasma display unit 20.

In a PDP 21, electrodes X1 to Xn, forming pairs with electrodes Y1 to Yn respectively, are provided parallel to one another, and address electrodes A1 to Am are provided intersecting them over a distance, to form m×n number of pixels in a matrix. The electrodes X1 to Xn are commonly connected at one end. Hereafter, the electrodes A1 to Am, the electrodes X1 to Xn and the electrodes Y1 to Yn are collectively referred to as electrodes A, electrodes X and electrodes Y respectively.

Voltage with the waveforms shown in FIG. 9 are applied to these electrodes. Voltages Va, Vsc and Vs in FIG. 9 are generated at a power source circuit 22 and are supplied to the electrodes via an address driver 23, a Y-common driver 24A, a scanning driver 25 and an X-common driver 26. In FIG. 6, Vcc is a power source voltage for a logic circuit and Vd is a power source voltage for a drive circuit. For instance, the discharge start voltages between adjacent electrodes X–Y and between electrodes A–Y that face opposite are at 290 V and 180 V respectively, and in this case, the power source voltages are, for instance, Vs=180 V, Va=50 V, Vsc=100 V Vcc=5 V, Vd=15 V.

The address driver 23, the Y-common driver 24A, the scanning driver 25 and the X-common driver 26 are controlled by control signals from a control circuit 27. The control circuit 27 generates the control signals using a dot clock CLK, a vertical synchronizing signal VSYNC and a horizontal synchronizing signal HSYNC which are provided from the outside, and converts the display data DATA, provided from the outside, to data for the PDP 21 and provides the converted data to the address driver 23.

The address driver 23 is provided with a shift register 231, a latch circuit 232 and an A-driver 233 with m number of outputs of the A-driver 233 connected to the address electrodes A1 to Am. The A-driver 233 is provided with m number of drivers which are structured identically in correspondence to the address electrodes A1 to Am, and the driver for the address electrode A1 is referred to as an A1-driver 2331. When display data corresponding to one line are transferred serially from the control circuit 27 to the shift register 231, these data are held in the latch circuit 232 and, based upon the output from the latch circuit 232, drive voltages are supplied to the address electrodes A1 to Am via the A-driver 233.

The scanning driver 25 is provided with a shift register 251 and a Y-driver 252. The Y-driver 252 is provided with n number of drivers structured identically and the driver for the electrode Y1 is referred to as a Y1-driver 2521. The outputs of these n number of drivers are connected to the electrodes Y1 to Yn. During an address period, "1" is supplied to the series data input of the shift register 251 only during the initial address cycle, and this is then shifted in synchronization with the address cycle so that electrodes Y1 to Yn are selected sequentially.

FIG. 8 shows a schematic structure of the drive circuit for the pixels 10. In FIG. 8, the drive circuit required during a reset period in which the wall charge for all the pixels is cleared, is omitted.

In FIG. 8, SW1 to SW15 are switch elements, D1 to D15 are diodes, L1 to L3 are coils and C1 and C2 are capacitors for power recovery.

The A1-driver 331 is a push/pull type, and when the first bit of the latch circuit 232 (see FIG. 6) is at "1", the switch SW2 is turned off and the switch SW1 is turned on so that a write voltage Va is supplied to the address electrode A1, whereas when the first bit of the latch circuit 232 is at "0", the switch SW1 is turned off and the switch SW2 is turned on so that 0 V is supplied to the address electrode A1.

The X-common driver 26 is provided with an X-sustaining voltage circuit 261 which is structured similarly to the A1-driver 233, and a power recovery circuit 262.

During a sustain period in FIG. 9, in a state in which the switches SW3 and SW4 are turned off and the voltage at the electrodes X is at 0 V, the switch SW12 is turned on first in order to start a sustaining pulse Ps, and then the charge accumulated in the capacitor C1 is supplied to the electrodes X through the diodes D12 and the coil L1. When the voltage at electrodes X rises to near the level of the sustaining voltage Vs, the switch SW3 is turned on to raise the voltage at the electrodes X up to the sustaining voltage Vs. The wall voltage is added to this voltage, then a sustaining discharge is generated and a wall charge with reverse polarity is collected on the MgO protective film 13. Then the switches SW12 and SW3 are turned off in that order.

The switch SW13 is turned on to cause the sustaining pulse Ps to fall and the electrical charge on the electrodes X is recovered in the capacitor C1 via the coil L1, the diode D13 and the switch SW13. When the voltage at the electrodes X falls to near 0 V, the switch SW4 is turned on so that the voltage at the electrodes X is brought down to 0 V. Then the switches SW13 and SW4 are turned off in that order.

The Y1-driver 2521 has a structure that is similar to that of the A1-driver 2331 and the X-sustaining voltage circuit 261.

The n number of drivers of the Y-driver 252 are connected in parallel to one another via lines SU and SD and the Y-common driver 24A is connected to these lines SU and SD to constitute a common circuit for the electrodes Y1 to Yn. The Y-common driver 24A is provided with a scanning voltage circuit 241A, a Y-sustaining voltage circuit 242A and a power recovery circuit 243A.

During an address period in FIG. 9, first, only the switches SW5, SW7 and SW8 among the switches SW5 to SW10, SW14 and SW15 are turned on, an unselected voltage Vsc is applied to the line SD and electrode Y1 and a selected voltage 0 V is applied to the line SU and then the switch SW5 is turned off to enable start of scanning. In this state, the switch SW6 is turned on and the selected voltage 0 V is applied to the electrode Y1. At this time, a primary discharge is performed between the electrode Y1 and selected address electrodes among the address electrodes A1 to an in correspondence to the display data, and triggered by this discharge, a discharge occurs between the electrodes X–Y so that the wall charge required for a sustaining discharge is accumulated on the MgO protective film 13. Then the switch SW6 is turned off and the switch SW5 is turned on to apply the unselected voltage Vsc to the electrode Y1. Subsequently, identical control is performed for the remaining n–1 number of drivers of the Y-driver 252 sequentially. In FIG. 9, Psc indicates the scanning pulse.

During a sustain period shown in FIG. 9, first, only the switch SW15 among the switches SW5 to SW10 and SW14 and SW15 is turned on, and the electrical charge accumulated in the capacitor C2 is supplied to the electrodes Y via the switch SW15, the diode D15, the coil L3 and the diode D6. Then, when the voltage at the electrodes Y rises to near the sustaining voltage Vs, the switch SW10 is turned on to raise the voltage at the electrodes Y up to the sustaining voltage Vs. A sustaining discharge occurs between the electrodes X–Y, where the sum of the sustaining voltage Vs and the wall voltage exceeds the discharge start voltage and a wall charge with reverse polarity is accumulated on the MgO protective film 13. Following this, the switches SW15 and SW10 are turned off in that order. Then, the switch SW14 is turned on, the electrical charge in the electrodes Y is recovered in the capacitor C2 via the diode D5, the coil L2, the diode D14 and the switch SW14. When the voltage at the electrodes Y falls to near 0 V, the switch SW9 is turned on so that the voltage at the Y electrodes is lowered down to 0 V. Then the switches SW14 and SW9 are turned off in that order.

With the waveforms of the voltages applied to the electrodes as shown in FIG. 11, during an address period, a reduction in power consumption is achieved by reducing the write voltage Va applied to the address electrodes A1 to An where the number of pulses is high, with the unselected voltage and the selected voltage at the electrodes Y1 to Yn being –Vsc and –VY respectively. A drive circuit that achieves this is shown in FIG. 10, in correspondence to the circuit shown in FIG. 8. The power source voltages are, for instance, Vs=180 V, Va=50 V, –VY=–150 V, –Vsc=–50 V.

At the Y-common driver 24A in FIG. 8 and the Y-common driver 24B in FIG. 10, since the discharge current for many pixels flows through the lines SD and SU during a sustain period, the impedance must be reduced by making these lines wide. Since there are two wide lines between the Y-sustaining voltage circuit 242A and the scanning voltage circuit 241 or 241A, the switch SW9 and the diode D9 must be connected to the line SD and the switch SW10 and the diode D10 must be connected to the line SU which is away from the line SD, and the diodes D9 and D10 are independent of the switches SW9 and SW10, the structure becomes complex, preventing higher integration of the driver and cost reduction.

Normally, power MOS transistors are used for switches. However, since a voltage at Vs+VY=330 V is applied to the switch SW6 in FIG. 10, when the switch SW10 is turned on, necessitating a switch to be employed for the switch SW6 with a high voltage standing, higher integration of the driver and cost reduction are prevented.

SUMMARY OF THE INVENTION

Accordingly, an object of the present invention is to provide an AC display unit and its drive circuit with simpler structures to achieve higher integration of the drive circuit and a reduction in the production costs.

According to the 1st aspect of the present invention, there is provided an AC plasma display unit comprising: a plasma display panel with scanning electrodes provided parallel to one another; and a drive circuit for applying a selected voltage to sequentially selected one of the scanning electrodes and applying an unselected voltage to unselected scanning electrodes in order to generate address discharge at said selected one to create a wall charge required for a sustaining discharge in correspondence to display data and for cyclically supplying a common sustain pulse to the scanning electrodes in order to achieve a sustaining discharge; the drive circuit including, as shown in FIG. 1 for example: push/pull circuits, each (2521) of the push/pull circuits being provided for each (Y1) of the scanning electrodes, each of the push/pull circuits having an output terminal connected to one (Y1) of the scanning electrodes, a first switch (SW6) connected between a first input terminal and the output terminal and a second switch (SW5) connected between a second input terminal and the output terminal; a scanning voltage circuit (241) having a first line (SU) connected to each the first input terminal of the push/pull circuits, a second line (SD) connected to each the second input terminal of the push/pull circuits, a first scan switch (SW8) for supplying a selected voltage (V1) to the first line (SU) via the first scan switch (SW8) and a second scan switch (SW7) for supplying an unselected voltage (V2) to the second line (SD) via the second scan switch (SW7); a sustaining voltage circuit (242) having a common line (SC), a first sustaining switch (SW9) for supplying a sustaining voltage (Vs) to the common line (SC) via the first sustaining switch (SW9) and a second sustaining switch (SW10) for supplying a reference voltage (0 V) to the common line (SC) via the second sustaining switch (SW10); and a separating circuit (244) having a separating switch (SW17) connected between the first line (SU) and the common line (SC) and a current control element (SW16), connected between the second line (SD) and the common line (SC), for switching on/off or allowing electric current to flow from the second line (SD) to the common line (SC) only.

With the 1st aspect of the present invention, by providing the separating circuit, the first line and the second line, through which a sustaining discharge current flows, can be connected to the common line at the sustaining voltage circuit and, since the sustaining voltage circuit is provided for only this common line, the structure of the sustaining voltage circuit is simplified and positional integration of the circuit elements is achieved, achieving a reduction in production costs.

In the 1st mode of the 1st aspect of the present invention, the push/pull circuit (2521) further comprises:

a first switching diode (D6) having a cathode connected to the output terminal and an anode connected to the first input terminal; and a second switching diode (D5) having an anode connected to the output terminal and a cathode connected to the second input terminal.

In the 2nd mode of the 1st aspect of the present invention, the separating switch (SW17) is an nMOS transistor, the nMOS transistor having a source connected to the first line (SU) and a drain connected to the common line (SC); and the scanning voltage circuit (241) has a scan switching diode (D8), an anode and a cathode of the scan switching diode (D8) being connected to the source and a gate of the nMOS transistor (SW17) respectively, the cathode of the scan switching diode being connected to the first scan switch.

With the 2nd mode, by turning on the first scan switch which is for turning on/off the application of the selected voltage to the first line, it becomes possible to turn off the first separation switch in the separating circuit at the same time, simplifying the control of the separating circuit.

In the 3rd mode of the 1st aspect of the present invention, the current control element (SW16) in the separating circuit (244) is a separation switching diode, an anode and a cathode of the separation switching diode (SW16) being connected to the second line (SD) and the common line (SC) respectively.

With the 3rd mode, since it is not necessary to perform on/off control for the separation switching diode, control of the separating circuit is simplified.

In the 4th mode of the 1st aspect of the present invention, the sustaining voltage circuit (242) has a first protective diode (D9) connected in parallel to the first sustaining switch (SW9) with an anode thereof connected to the common line (SC) and a second protective diode (D10) connected in parallel to the second sustaining switch (SW10) with a cathode thereof being connected to the common line (SC).

In the 5th mode of the 1st aspect of the present invention, the drive circuit further comprises a power recovery circuit (243) for supplying electrical charge accumulated in a capacitor (C2) previous to application of the sustaining voltage to the scanning electrodes via the common line (SC) and for recovering electrical charge on the scanning electrodes into the capacitor (C2) via the common line (SC) after a sustaining discharge.

With the 5th mode, since it is necessary to connect the power recovery circuit only to the common line, only one coil is required in the power recovery circuit, simplifying the structure of the power recovery circuit.

According to the 2nd aspect of the present invention, there is provided an AC plasma display unit comprising, as shown in FIG. 2 for example: a separating circuit (244) having a separating switch (SW17) connected either between the first line (SU) and the common line (SC) or between the second line (SD) and the common line (SC) with the other being electrically continuous; and the same elements, except this separating circuit, as of the first aspect of the present invention.

With the 2nd aspect of the present invention, by providing the separating circuit, the first line and the second line, through which a sustaining discharge current flows, can be connected to the common line at the sustaining voltage circuit and, since the sustaining voltage circuit is provided for only this common line, the structure of the sustaining voltage circuit is simplified and positional integration of the circuit elements is achieved, achieving a reduction in production costs.

DESCRIPTION OF THE PREFERRED EMBODIMENTS

Figure 1:
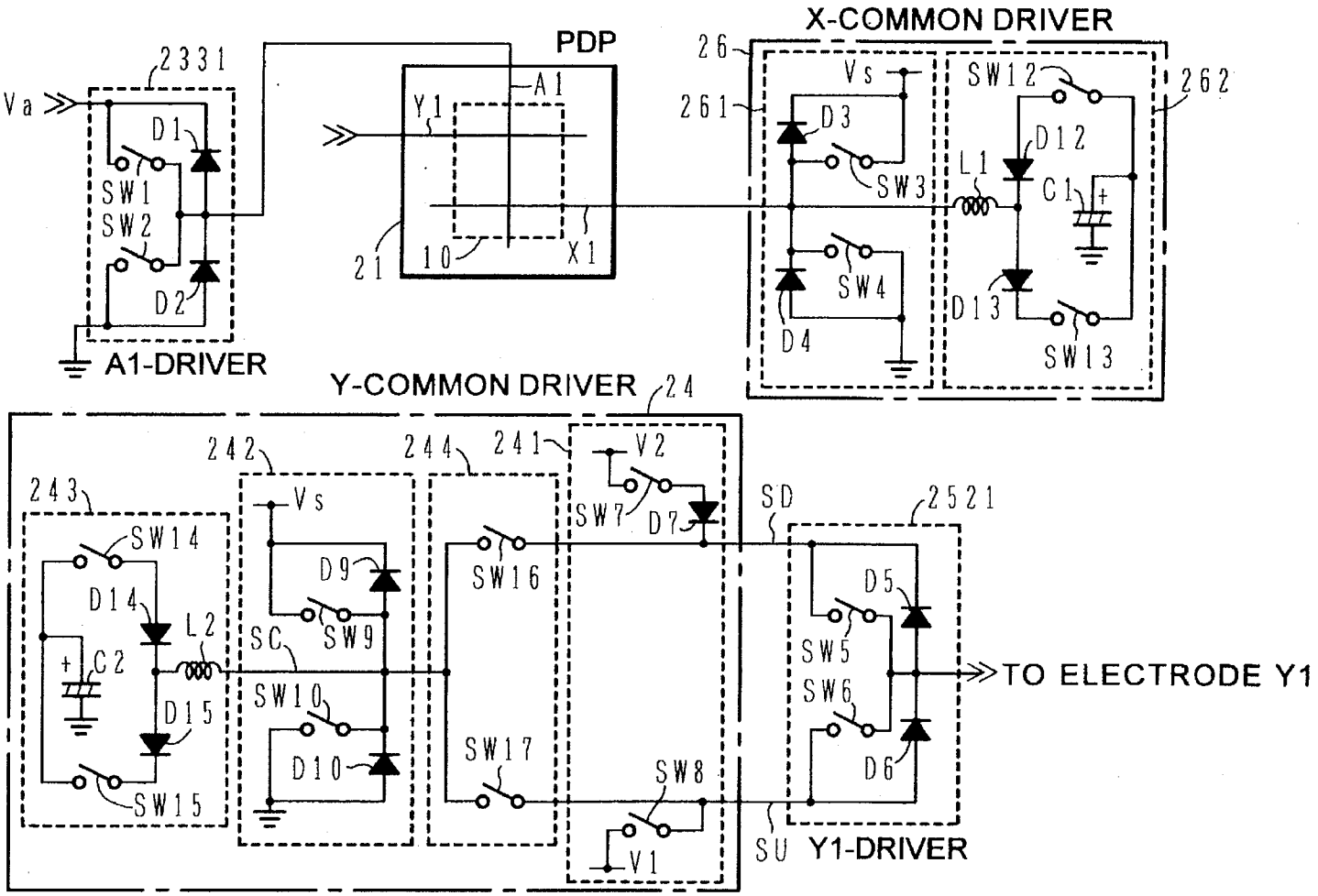
FIG. 1 is a schematic diagram of a drive circuit for one pixel in an AC plasma display unit in an aspect of the present invention.

Referring now to the drawings, wherein like reference characters designate like or corresponding parts throughout several views, preferred embodiments of the present invention are described below.

First Embodiment

Figure 2:
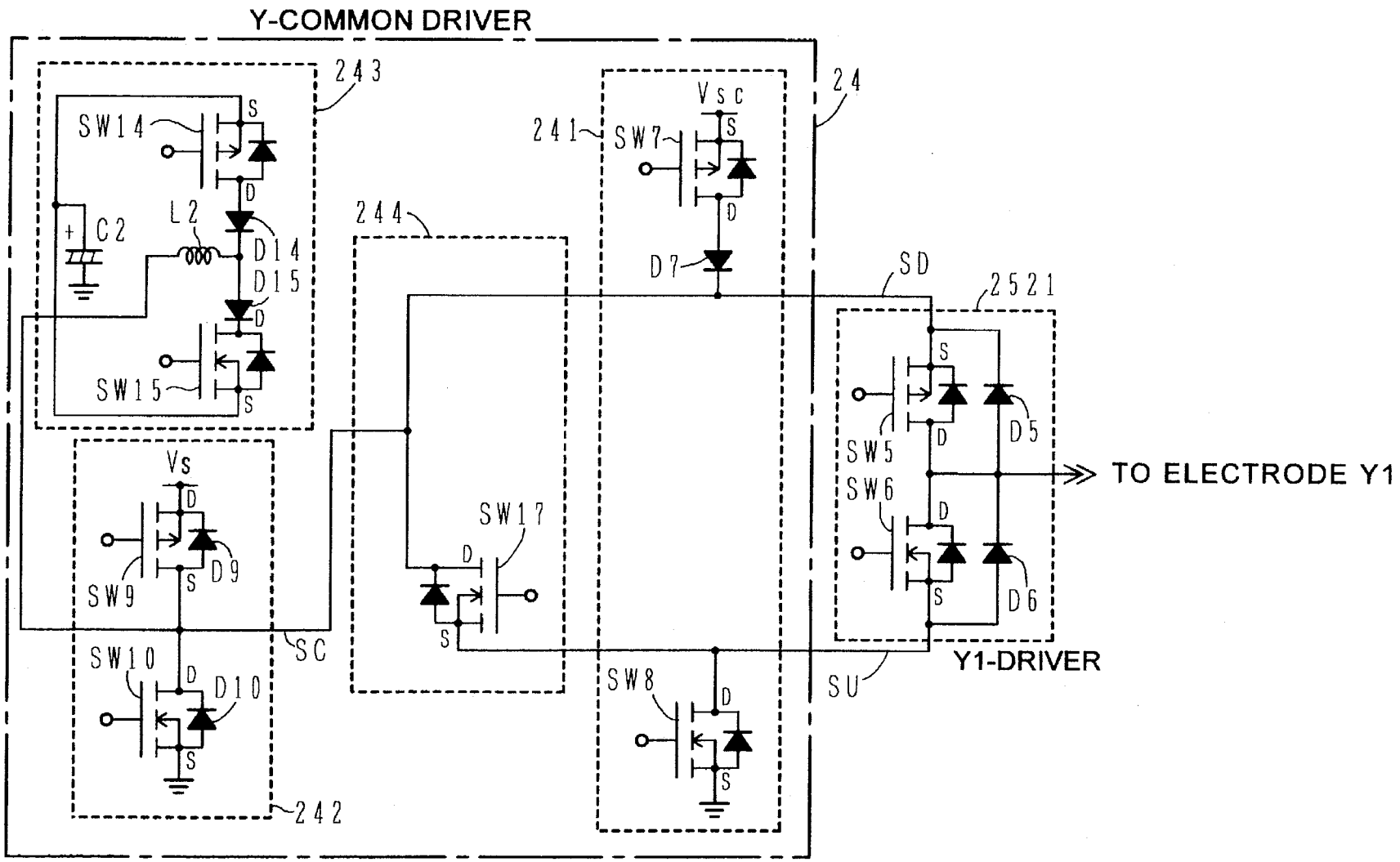
FIG. 2 is a circuit diagram of a Y-side driver in the first embodiment of the aspect in FIG. 1.

FIG. 2 is a circuit diagram of the Y-side driver in FIG. 1 in a first embodiment. This Y-side driver is an improvement on the Y-driver shown in FIG. 8.

Switches SW5, SW7, SW9 and SW14 are each constituted with a pMOS transistor and switches SW6, SW8, SW10, SW15 and SW17 are each constituted with an nMOS transistor. These MOS transistors are power transistors. A power MOS transistor with a diode for clipping a voltage between the source and drain of the MOS transistor so as to protect the MOS transistor, is commercially available as a semiconductor device and this device does not require a protective diode to be externally mounted. A Y1-driver 2521 is for an electrode Y1. Since it is necessary to provide identically structured circuits for electrodes Y1 to Yn and their drive capability is relatively low, they are integrated. In contrast, a power MOS transistor inside a Y-common driver 24 commonly serves the electrodes Y1 to Yn, and consequently the power MOS transistor is large part, provided separately.

Figure 8:
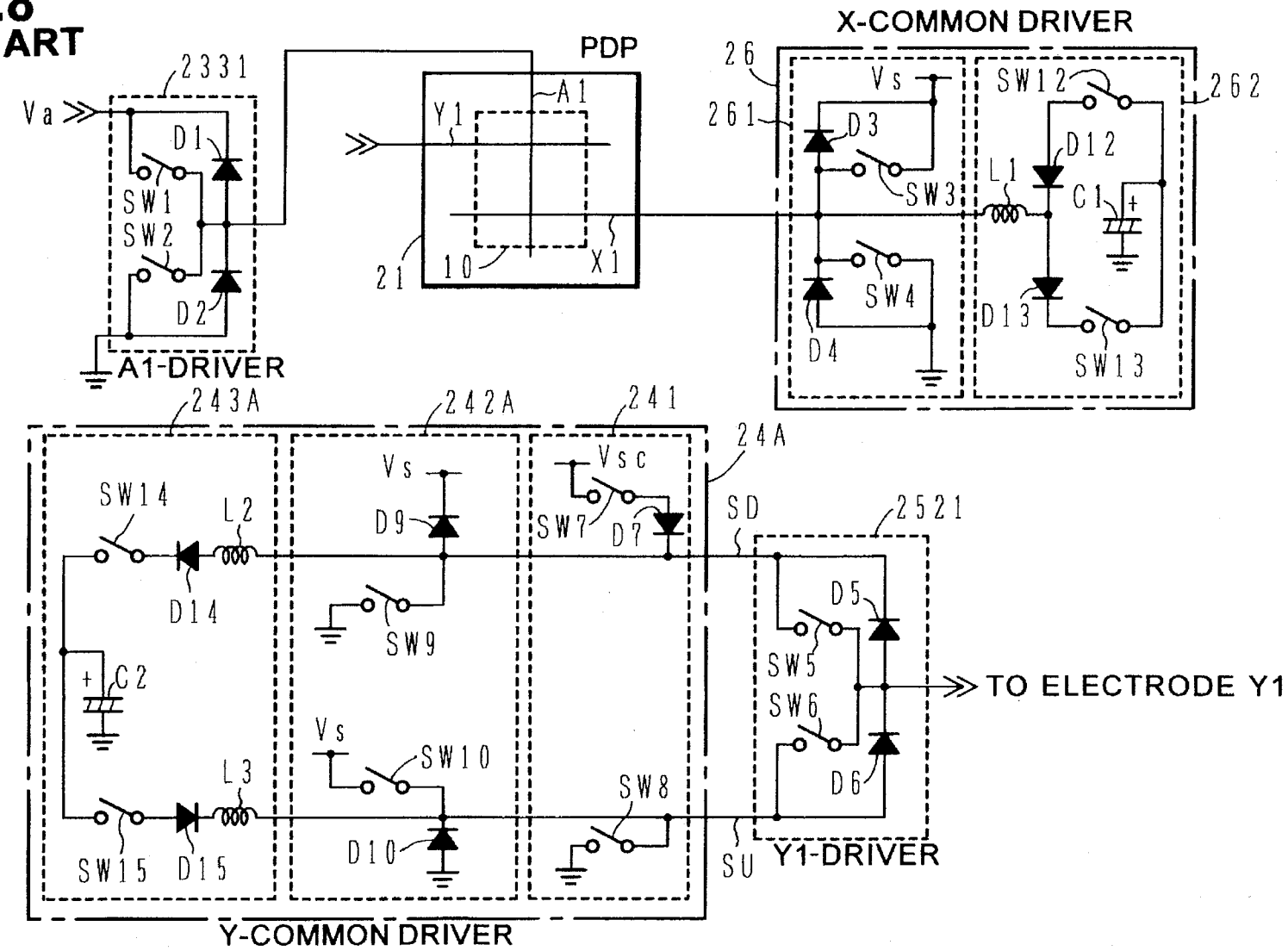
FIG.8 PRIOR ART
FIG. 8 is a schematic diagram of a drive circuit in the prior art for one pixel in the AC plasma display unit shown in FIG. 6.
Figure 10:
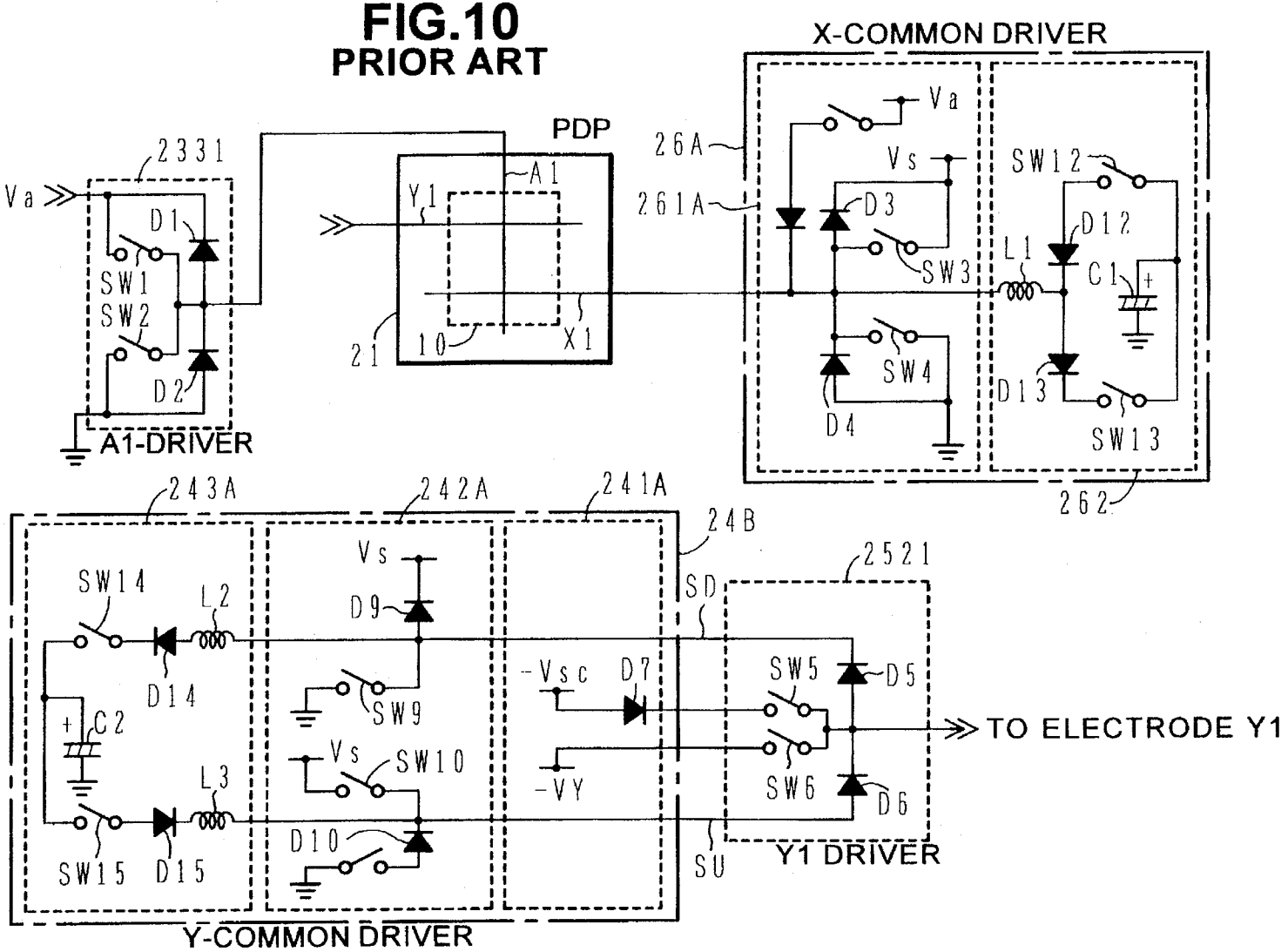
FIG.10 PRIOR ART
FIG. 10 is a schematic diagram of another drive circuit in the prior art for one pixel in the AC plasma display unit shown in FIG. 6.
Figure 11:
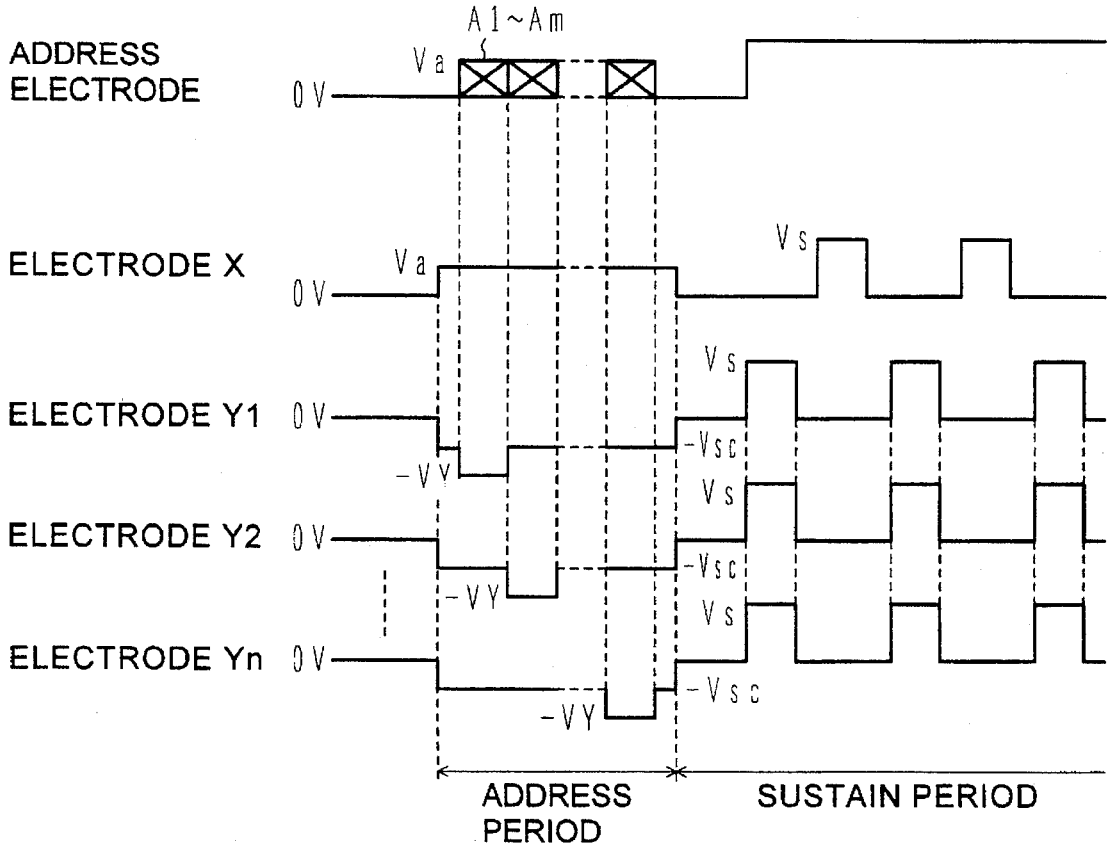
FIG.11 PRIOR ART
FIG. 11 is a voltage waveform diagram illustrating the operation of the circuit shown in FIG. 10.

A Y-sustaining voltage circuit 242 employs protective diodes D9 and D10 which are integrated in the power MOS transistor, and since it is not necessary to provide large diodes D9 and D10 which are independent of the switches SW9 and SW10 shown in FIGS. 8 and 10, the number of parts is reduced. Furthermore, since the switches SW9 and SW10 are connected to one line, i.e., the line SC, integration is achieved in the arrangement on the substrate, resulting in a more compact structure.

A separating circuit 244 employs an nMOS transistor for a switch SW17, with its drain D connected to the line SC and its source S connected to a line SU.

Figure 3:
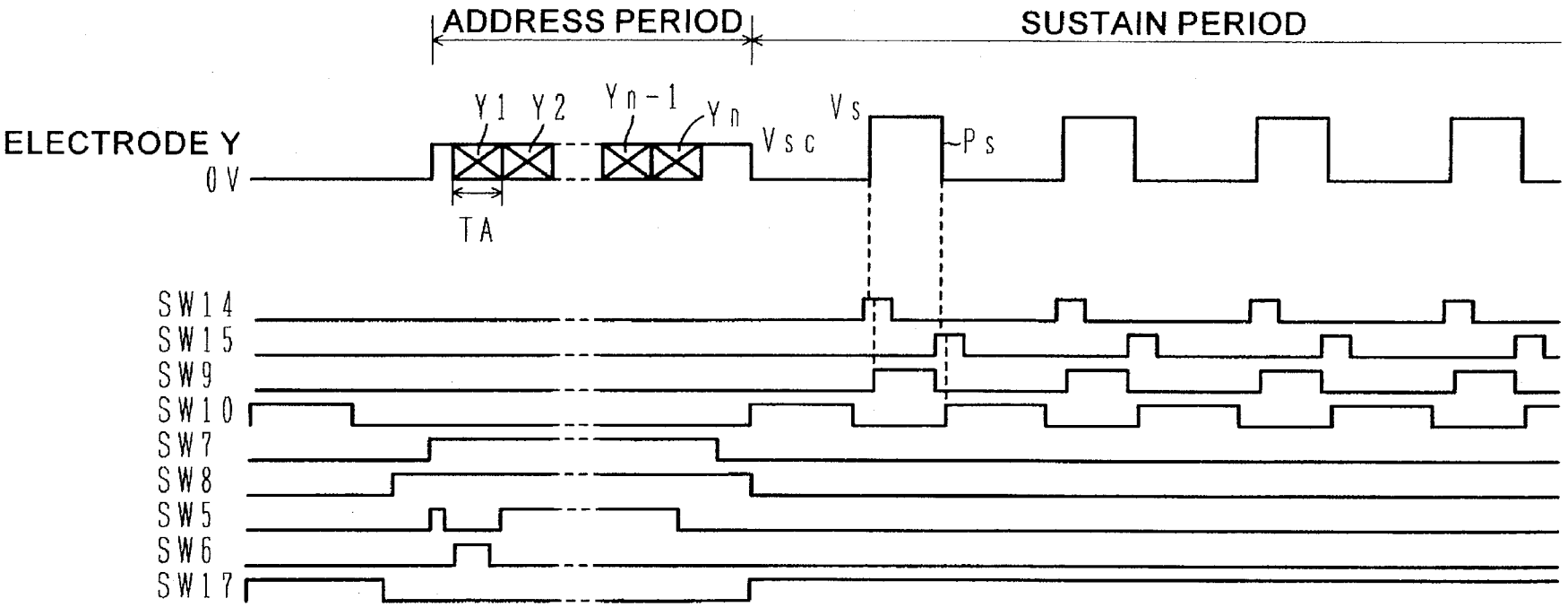
FIG. 3 is a voltage waveform diagram illustrating the operation of the circuit shown in FIG. 2.
Figure 9:
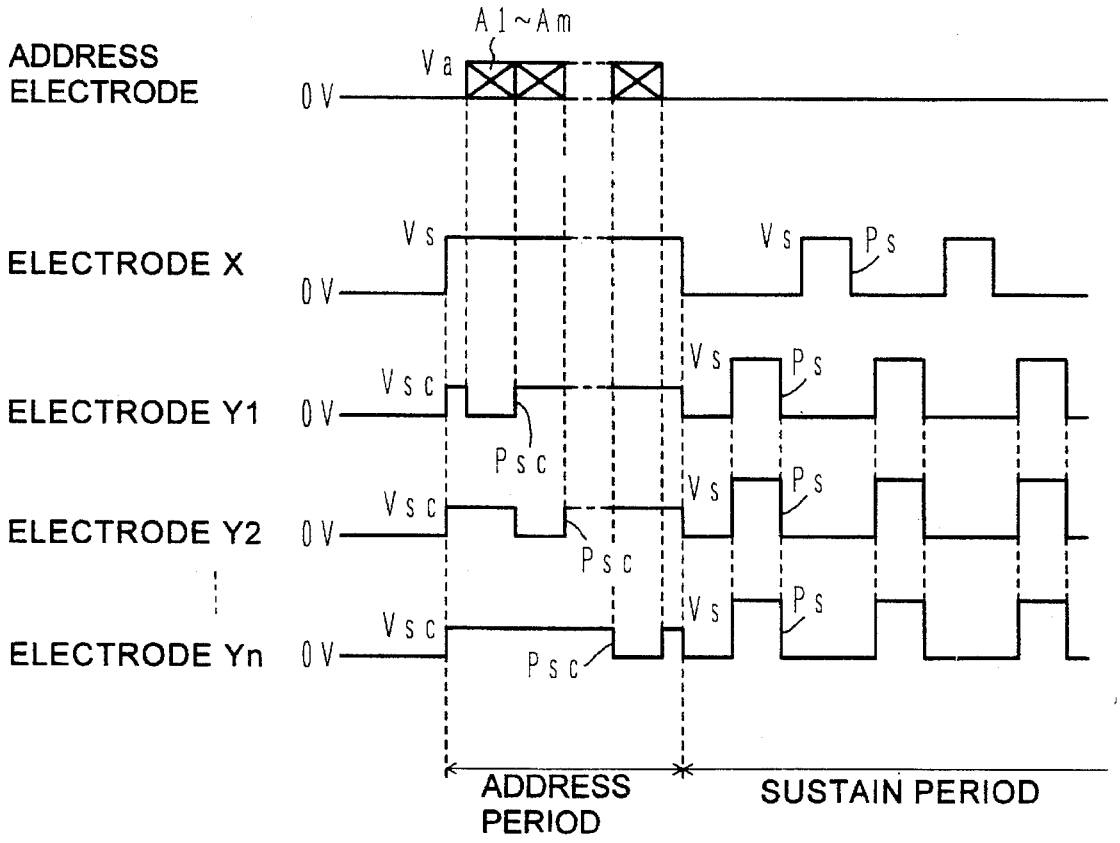
FIG.9 PRIOR ART
FIG. 9 is a voltage waveform diagram illustrating the operation of the circuit shown in FIG. 8.

Now, the operation of the Y-side driver structured as described above, is explained in reference to FIG. 3. The waveforms of the voltages applied to the electrodes are identical to those shown in FIG. 9 and in order to indicate the relationship between the waveforms and the positions over time, FIG. 3 shows only the waveform of the voltage applied to the electrodes Y. The waveform of the voltage applied to the electrodes Y during an address period represent an integrated and simplified waveform of the electrodes Y1 to Yn in FIG. 9, and Y1 to Yn in FIG. 3 indicate positions of scanning pulses applied to the corresponding electrodes. In the waveforms for the switches, high indicates ON and low indicates OFF.

During an address period, the switch SW17 is turned off to cut off the line SD from the line SU, and, at the same time, the switch SW8 is turned on to set the selected voltage 0 V for the line SU. Following this, the switch SW7 is turned on to set the unselected voltage Vsc for the line SD, and then the switch SW5 is turned on (likewise for the drivers for the electrodes Y2 to Yn) to set the unselected voltage Vsc for the electrodes Y1 to Yn. Next, the switch SW5 is turned off (likewise for the drivers for the electrodes Y2 to Yn). With this, preparation for scanning the electrodes Y1 to Yn is completed.

Next, the switch SW6 of the Y1-driver 2521 is turned on in order to select the electrode Y1, the selected voltage 0 V is set for the electrode Y1, primary discharge is performed between the electrodes A1–Y1. When the voltage at the address electrode A1 is the write voltage Va, a write discharge occurs, triggered by this primary discharge, between the electrodes X1–Y1 and the wall charge required for a sustaining discharge is accumulated on the MgO protective film 13. Since the wall voltage has a polarity that is the reverse of that of the voltage applied between the electrodes X1–Y1, the voltage becomes lower than the discharge start voltage, to end the discharge. Then, the switch SW6 is turned off and the switch SW5 is turned on to set the unselected voltage Vsc for the electrode Y1.

The same procedure as that performed for the electrode Y1 is subsequently performed for the electrodes Y2 to Yn. When the selection of Yn is completed, the switch SW5 is turned off (likewise for the drivers of the electrodes Y2 to Yn), then the switch SW7 is turned off and the switch SW8 is turned off.

During a sustain period, first, the switch SW17 is turned on. Concurrently with this, the switch SW10 is turned on and the electrical charge on the electrodes Y1 to Yn is discharged through the diode D5 and the switch SW10 to set 0 V for the electrodes Y1 to Yn. The switch SW10 is turned off and preparation for the application of a sustaining pulse Ps is completed.

Then, the switch SW14 of a power recovery circuit 243 is turned on, and the electric current from a capacitor C2 flows into the electrodes Y1 to Yn via the switch SW14, a diode D14, a coil L2, the switch SW17 and the diode D6 to raise up the sustaining pulse Ps. The voltage at the electrodes Y1 to Yn rises and even when the voltage reaches Vs/2, the electric current keeps flowing due to the LC resonance resulting from the coupling of the capacity of the coil L2 and the capacity of the PDP so that the voltage keeps rising to near the sustaining voltage Vs. The switch SW9 is turned on with a delay of approximately 100 to 200 ns after the switch SW14 is turned on and the voltage at the electrodes Y1 to Yn is raised up to the level of the sustaining voltage Vs. At this point, the voltage at the electrodes X1 to Xn is 0 V and sustaining discharge occurs between the corresponding electrodes X–Y if the sum of the sustaining voltage Vs and the wall voltage exceeds the discharge start voltage. A wall charge with reverse polarity is accumulated on the MgO protective film 13 and the discharge ends when the sum of the wall voltage and the voltage applied between the electrodes X–Y becomes lower than the discharge start voltage. The sustaining discharge current is supplied from the sustaining voltage supply line Vs to the electrodes Y1 to Yn via the switches SW9 and SW17 and the diode D6. Then, the switches SW14 and SW9 are turned off in that order.

Although Vs>Vsc, a diode D7 prevents a through current to the unselected voltage supply line Vsc through the diode D5 and the protective diode of the switch SW7.

Next, the switch SW15 is turned on, the electric current from the electrodes Y1 to Yn flows to the capacitor C2 via the diode D5, the coil L2, the diode D15 and the switch SW15 to bring down the sustaining pulse Ps. Even when the voltage at the electrodes Y1 to Yn has come down to the level of Vs/2, the LC resonance causes the electric current to keep flowing until the voltage falls to near 0 V. Then, the switch SW10 is turned on so that the voltage at the electrodes Y1 to Yn is lowered down to 0 V.

Next, the sustaining pulse Ps is supplied to the electrodes X1 to Xn and a sustaining discharge occurs between the electrodes X–Y in the same manner as that described above. The voltage at the electrodes Y1 to Yn would rise at this point, due to the discharge current, but since the switch SW10 is on, the rise is prevented.

In the first embodiment according to the present invention, since the switch SW16 in FIG. 1 is omitted, an ON/OFF control of that is not required, simplifying the structure of a control circuit for the separate circuit 244.

Second Embodiment

Figure 4:
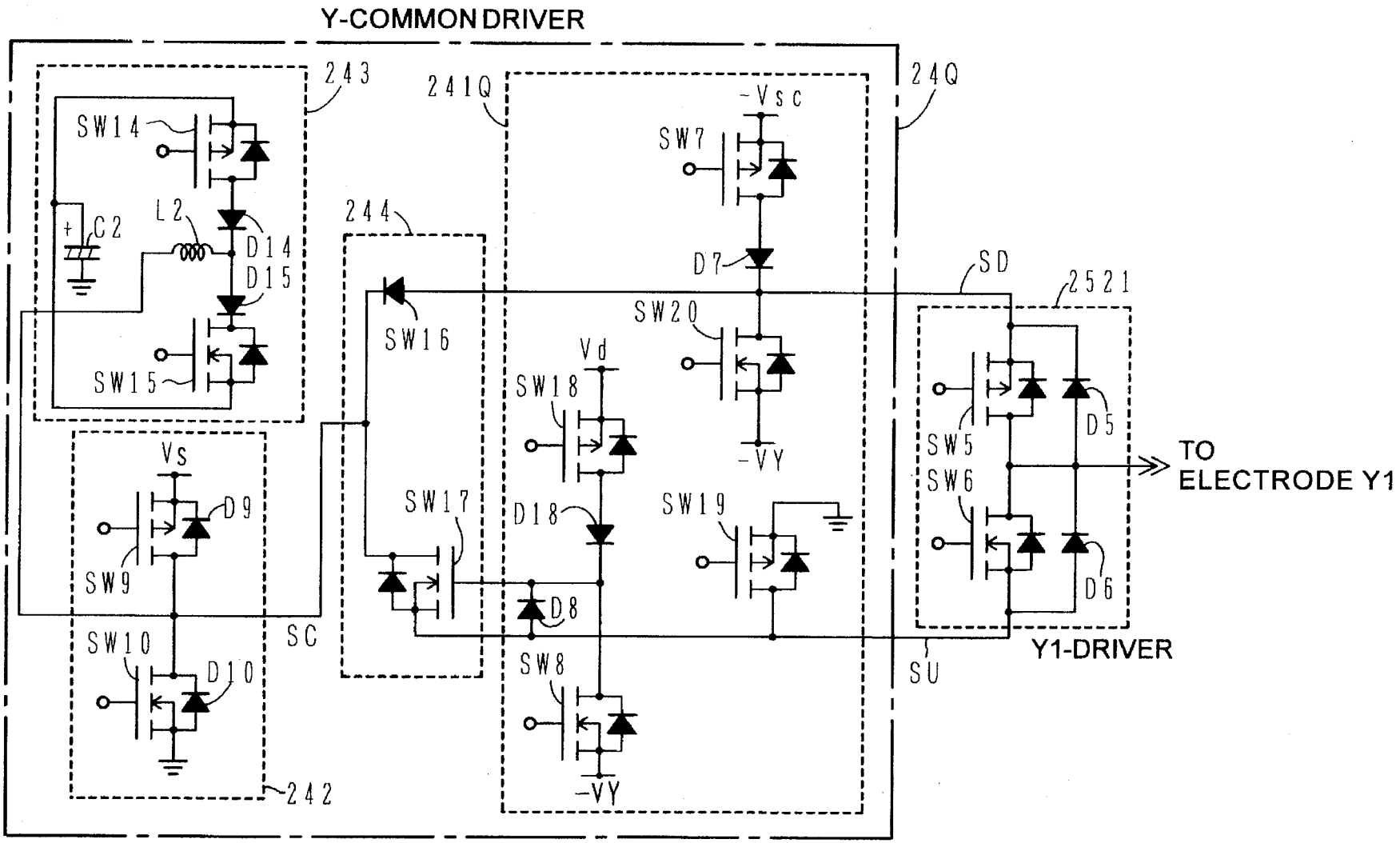
FIG. 4 is a circuit diagram of a Y-side driver in the second embodiment of the aspect in FIG. 1.

FIG. 4 is a circuit diagram of the Y-side driver in FIG. 1 in the second embodiment. This Y-side driver is an improvement on the Y-side driver shown in FIG. 10.

A scanning voltage circuit 241Q has a structure in which switches SW18, SW19 and SW20 and diodes D8 and D18 are added to the scanning voltage circuit 241 shown in FIG. 2. The switches SW18 and SW19 are each constituted with a pMOS transistor and the switch SW20 is constituted with an nMOS transistor. In each case, a protective diode, which is integrated with the transistor, is connected to the transistor in parallel.

The switch SW18 is for turning on the switch SW17, and the switch SW8 is for turning off the switch SW17 and also drawing the voltage in the line SU into the selected voltage –VY via the diode D8 and the switch SW8. The switch SW19 is for setting the voltage in the line SU to 0 V. A switch SW20 is for temporarily lowering the voltage in the line SD to the selected voltage –VY in order to ensure that the switch SW7, for setting the voltage in the line SD into the unselected voltage –Vsc, can be turned on.

Figure 5:
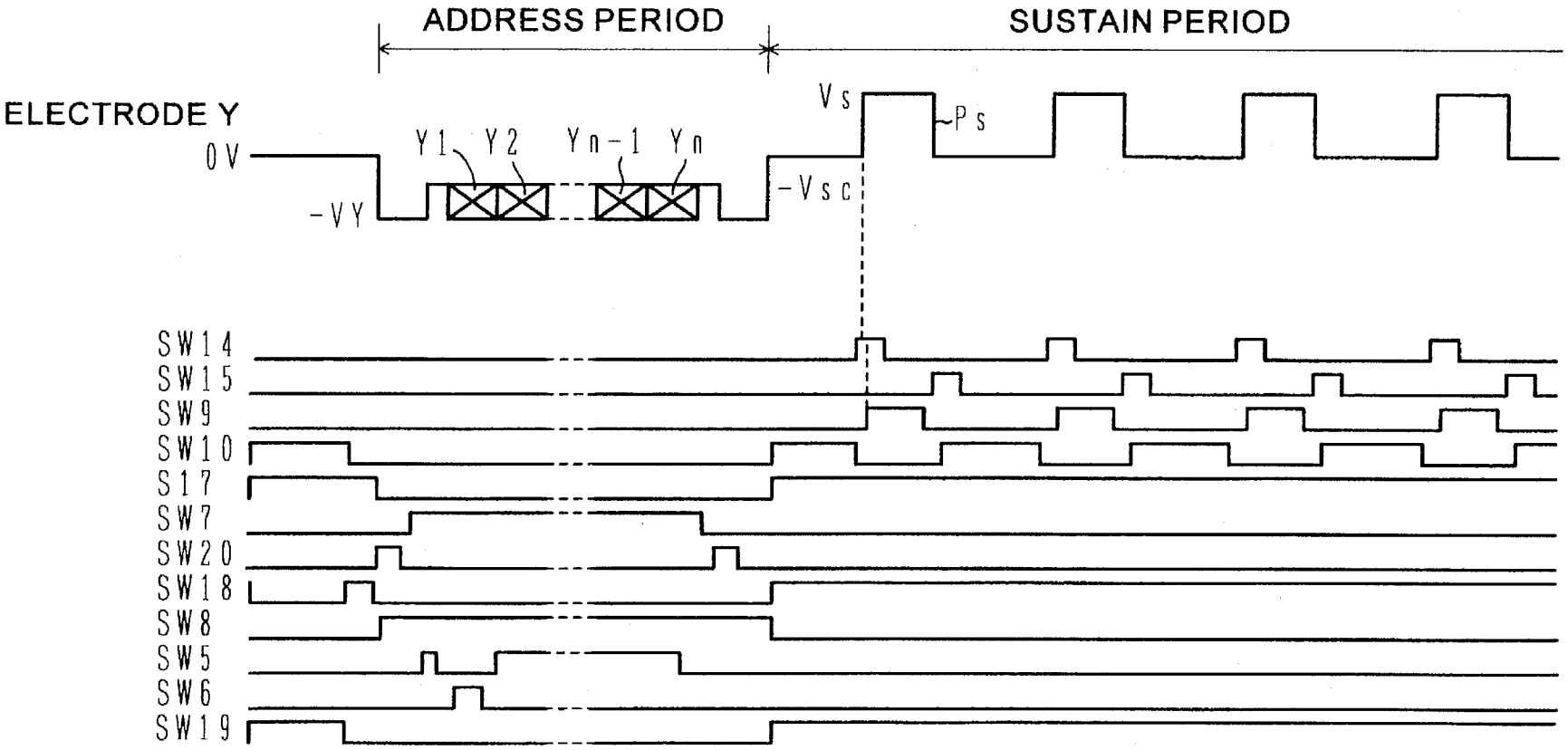
FIG. 5 is a waveform diagram illustrating the operation of the circuit shown in FIG. 4.
Figure 6:
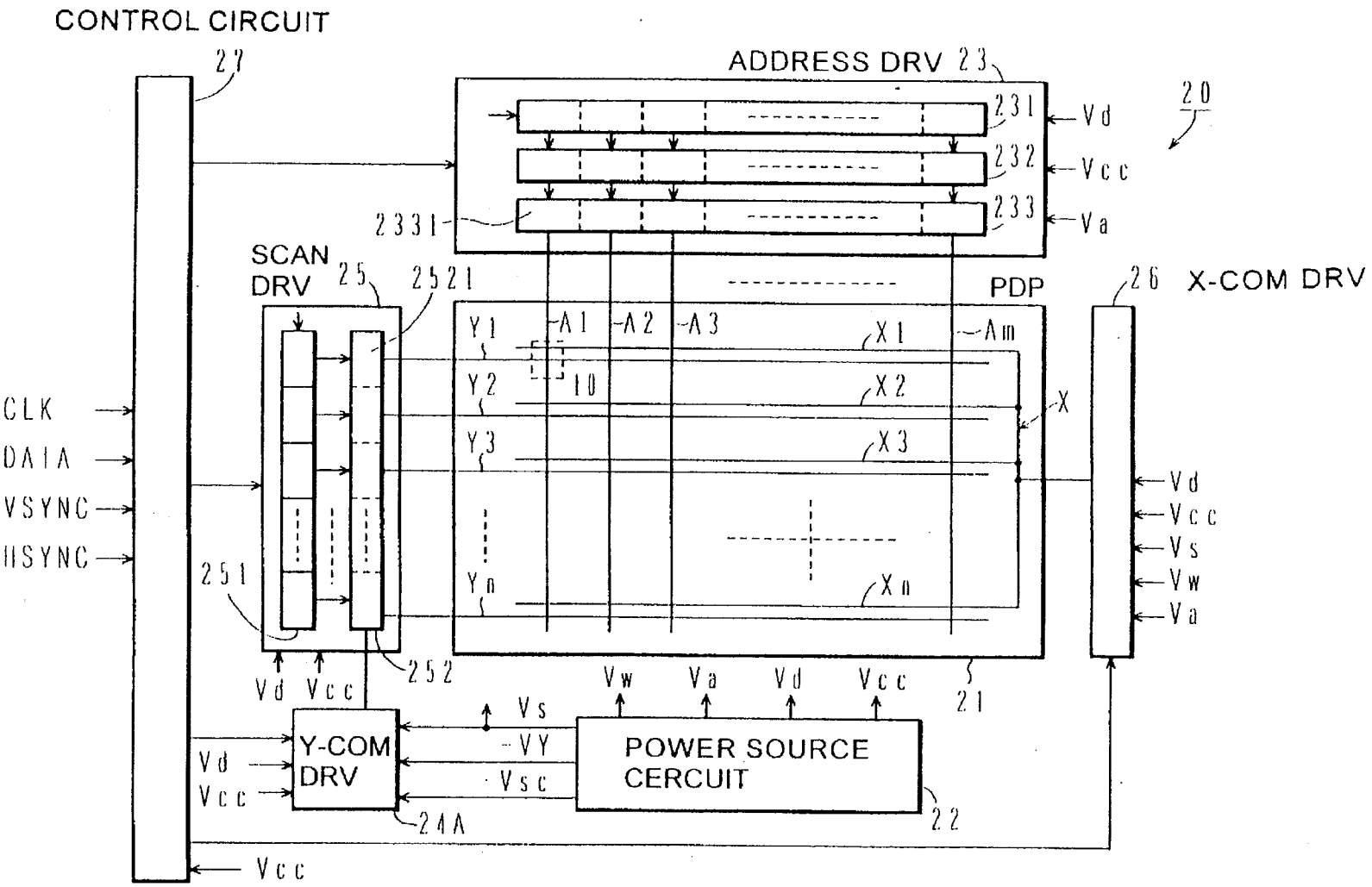
FIG.6 PRIOR ART
FIG. 6 is a block diagram showing the schematic structure of an AC plasma display unit in the prior art.
Figure 7:
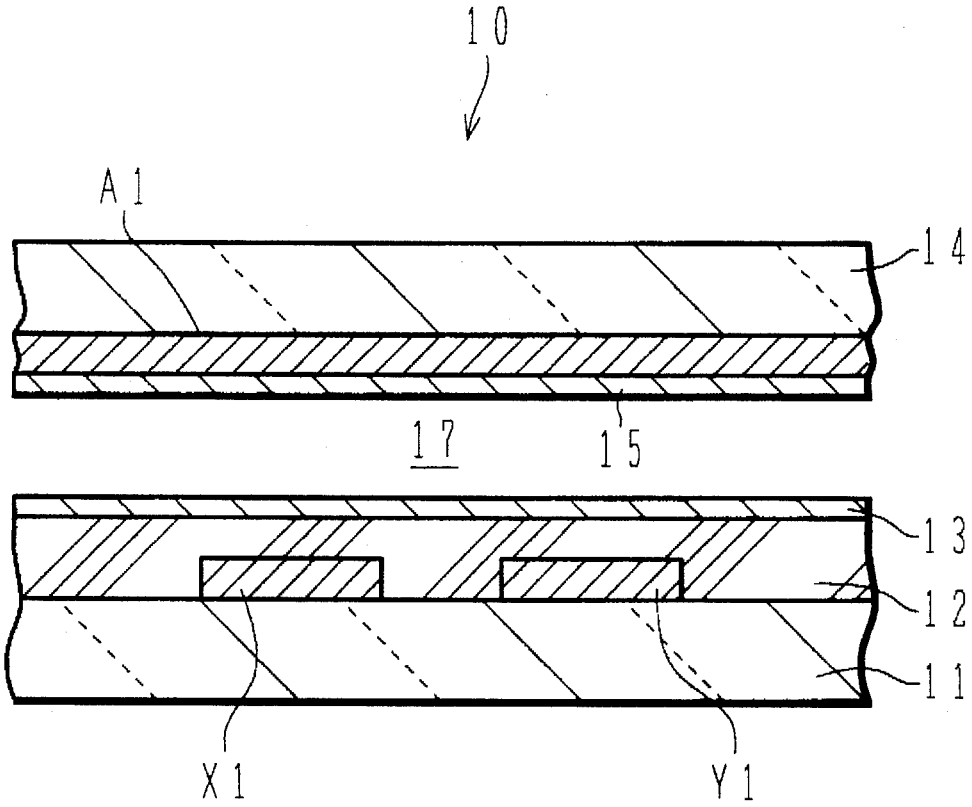
FIG.7 PRIOR ART
FIG. 7 is a cross section of one pixel in the PDP in FIG. 6, viewed along the address electrodes.

Now the operation of the Y-side driver structured as described above is explained in reference to FIG. 5.

During an address period, the switch SW18 is turned off and the switch SW8 is turned on, turning off the switch SW17, discharging the electrical charge on the line SU via the diode D8 and the switch SW8 and setting the line SU for the selected voltage –VY. At the same time, the switch SW20 is turned on so that the electrical charge on the electrode Y1 is discharged via the diode D8 and the switch SW20, and the voltages at the electrode Y1 and the line SD are drawn into the selected voltage –VY. Then, the switch SW20 is turned off and the switch SW7 is turned on to raise the voltage in the line SD to the unselected voltage –Vsc. Next, the switch SW5 is turned on, the voltage at the electrodes Y1 to Yn is set at the unselected voltage –Vsc and the switch SW5 is turned off. With this, preparation for scanning of the electrodes Y1 to Yn is completed.

The presence of the switch SW16 and the fact that the switch SW17 is turned off prevents electric current from frowning into the lines SD and SU from the ground line via the diode D10. In other words, during an address period, the Y-sustaining voltage circuit 242 and the scanning voltage circuit 241Q are electrically disconnected from each other by the separating circuit 244.

Next, the switch SW6 of the Y1-driver 2521 is turned on to set the selected voltage –VY for the electrode Y1 and an address discharge occurs. Then the switch SW6 is turned off.

The same procedure as that performed for the electrode Y1 is performed for the electrodes Y2 to Yn. When the selection of Yn is completed, the switch SW5 is turned off (likewise for the driver of the electrodes Y2 to Yn) and then the switch SW7 is turned off. Next, the switch SW20 is turned on to set the selected voltage –VY for the line SD, and the switch SW20 is turned off. Next, the switch SW8 is turned off.

During a sustain period, the switch SW19 is turned on so that the voltage in the line SU is raised to 0 V, the voltage in the line SD, too, is raised to 0 V via the diodes D6 and D5 and, concurrently with this, the switch SW10 is turned on. Next, the switch SW18 is turned on, turning on the switch SW17. With this, the Y-sustaining voltage circuit 242 and the scanning voltage circuit 241Q enter a connected state to enable application of the sustaining pulse. The subsequent operation is identical to that shown in FIG. 3.

Although preferred embodiments of the present invention has been described, it is to be understood that the invention is not limited thereto and that various changes and modifications may be made without departing from the spirit and scope of the invention.

For instance, in the structure shown in FIG. 2, the switch SW17 may be connected in the line SD between the diode D7 and the line SC instead of being in the line SU between the switch SW8 and the line SC. Also, in FIG. 4, the switch SW16 may be constituted with a MOS transistor. Furthermore, the diodes may be constituted with MOS transistors, as long as they are diode means that allow electric current to flow in one direction only.

What is claimed is:

1. An AC plasma display unit comprising:

a plasma display panel with scanning electrodes provided parallel to one another; and a drive circuit for applying a selected voltage to sequentially selected one of said scanning electrodes and applying an unselected voltage to unselected scanning electrodes in order to generate address discharge at said selected one to create a wall charge required for a sustaining discharge in correspondence to display data and for cyclically supplying a common sustain pulse to said scanning electrodes in order to achieve a sustaining discharge;

said drive circuit including:

push/pull circuits, each of said push/pull circuits being provided for each of said scanning electrodes, each of said push/pull circuits having an output terminal connected to one of said scanning electrodes, a first switch connected between a first input terminal and said output terminal and a second switch connected between a second input terminal and said output terminal;

a scanning voltage circuit having a first line connected to each said first input terminal of said push/pull circuits, a second line connected to each said second input terminal of said push/pull circuits, a first scan switch for supplying a selected voltage to said first line via said first scan switch and a second scan switch for supplying an unselected voltage to said second line via said second scan switch;

a sustaining voltage circuit having a common line, a first sustaining switch for supplying a sustaining voltage to said common line via said first sustaining switch and a second sustaining switch for supplying a reference voltage to said common line via said second sustaining switch; and a separating circuit having a separating switch connected between said first line and said common line and a current control element, connected between said second line and said common line, for switching on/off or allowing electric current to flow from said second line to said common line only.

2. An AC plasma display unit according to claim 1, wherein said push/pull circuit further comprises:

a first switching diode having a cathode connected to said output terminal and an anode connected to said first input terminal; and a second switching diode having an anode connected to said output terminal and a cathode connected to said second input terminal.

3. An AC plasma display unit according to claim 2, wherein said separating switch is an nMOS transistor, said nMOS transistor having a source connected to said first line and a drain connected to said common line; and wherein said scanning voltage circuit has a scan switching diode, an anode and a cathode of said scan switching diode being connected to said source and a gate of said nMOS transistor respectively, said cathode of said scan switching diode being connected to said first scan switch.

4. An AC plasma display unit according to claim 3, wherein said current control element in said separating circuit is a separation switching diode, an anode and a cathode of said separation switching diode being connected to said second line and said common line respectively.

5. An AC plasma display unit according claim 4, wherein said sustaining voltage circuit has a first protective diode connected in parallel to said first sustaining switch with an anode thereof connected to said common line and a second protective diode connected in parallel to said second sustaining switch with a cathode thereof being connected to said common line.

6. An AC plasma display unit according to claim 1, further comprising a power recovery circuit for supplying electrical charge accumulated in a capacitor previous to application of said sustaining voltage to said scanning electrodes via said common line and for recovering electrical charge on said scanning electrodes into said capacitor via said common line after a sustaining discharge.

7. An AC plasma display unit comprising:

a plasma display panel with scanning electrodes provided parallel to one another; and a drive circuit for applying a selected voltage to sequentially selected one of said scanning electrodes and applying an unselected voltage to unselected scanning electrodes in order to generate address discharge at said selected one to create a wall charge required for a sustaining discharge in correspondence to display data and for cyclically supplying a common sustain pulse to said scanning electrodes in order to achieve a sustaining discharge;

said drive circuit including:

push/pull circuits, each of said push/pull circuits being provided for each of said scanning electrodes, each of said push/pull circuits having an output terminal connected to one of said scanning electrodes, a first switch connected between a first input terminal and said output terminal and a second switch connected between a second input terminal and said output terminal;

a scanning voltage circuit having a first line connected to each said first input terminal of said push/pull circuits, a second line connected to each said second input terminal of said push/pull circuits, a first scan switch for supplying a selected voltage to said first line via said first scan switch and a second scan switch for supplying an unselected voltage to said second line via said second scan switch;

a sustaining voltage circuit having a common line, a first sustaining switch for supplying a sustaining voltage to said common line via said first sustaining switch and a second sustaining switch for supplying a reference voltage to said common line via said second sustaining switch; and a separating circuit having a separating switch connected either between said first line and said common line or between said second line and said common line with the other being electrically continuous.

8. An AC plasma display unit according to claim 7, wherein said push/pull circuit further comprises:

a first switching diode having a cathode connected to said output terminal and an anode connected to said first input terminal; and a second switching diode having an anode connected to said output terminal and a cathode connected to said second input terminal.

9. An AC plasma display unit according to claim 8, wherein said separating switch is an nMOS transistor, said nMOS transistor having a source connected to said first line and a drain connected to said common line; and wherein said scanning voltage circuit having a scan switching diode, an anode and a cathode of said scan switching diode being connected to said source and a gate of said nMOS transistor respectively, said cathode of said scan switching diode being connected to said first scan switch.

10. An AC plasma display unit according to claim 9, wherein said current control element in said separating circuit is a separation switching diode, an anode and a cathode of said separation switching diode being connected to said second line and said common line respectively.

11. An AC plasma display unit according claim 10, wherein said sustaining voltage circuit has a first protective diode connected in parallel to said first sustaining switch with an anode thereof connected to said common line and a second protective diode connected in parallel to said second sustaining switch with a cathode thereof being connected to said common line.

12. An AC plasma display unit according to claim 11, further comprising a power recovery circuit for supplying electrical charge accumulated in a capacitor previous to application of said sustaining voltage to said scanning electrodes via said common line and for recovering electrical charge on said scanning electrodes into said capacitor via said common line after a sustaining discharge.

13. An AC plasma display panel drive circuit for driving a plasma display panel with scanning electrodes provided parallel to one another, said drive circuit being for applying a selected voltage to sequentially selected one of said scanning electrodes and applying an unselected voltage to unselected scanning electrodes in order to generate address discharge at said selected one to create a wall charge required for a sustaining discharge in correspondence to display data, and for cyclically supplying a common sustain pulse to said scanning electrodes in order to achieve a sustaining discharge, said drive circuit comprising:

push/pull circuits, each of said push/pull circuits being provided for each of said scanning electrodes, each of said push/pull circuits having an output terminal connected to one of said scanning electrodes, a first switch connected between a first input terminal and said output terminal and a second switch connected between a second input terminal and said output terminal;

a scanning voltage circuit having a first line connected to each said first input terminal of said push/pull circuits, a second line connected to each said second input terminal of said push/pull circuits, a first scan switch for supplying a selected voltage to said first line via said first scan switch and a second scan switch for supplying an unselected voltage to said second line via said second scan switch;

a sustaining voltage circuit having a common line, a first sustaining switch for supplying a sustaining voltage to said common line via said first sustaining switch and a second sustaining switch for supplying a reference voltage to said common line via said second sustaining switch; and a separating circuit having a separating switch connected between said first line and said common line and a current control element, connected between said second line and said common line, for switching on/off or allowing electric current to flow from said second line to said common line only.

14. An AC plasma display panel drive circuit for driving a plasma display panel with scanning electrodes provided parallel to one another, said drive circuit being for applying a selected voltage to sequentially selected one of said scanning electrodes and applying an unselected voltage to unselected scanning electrodes in order to generate address discharge at said selected one to create a wall charge required for a sustaining discharge in correspondence to display data, and for cyclically supplying a common sustain pulse to said scanning electrodes in order to achieve a sustaining discharge, said drive circuit comprising:

push/pull circuits, each of said push/pull circuits being provided for each of said scanning electrodes, each of said push/pull circuits having an output terminal connected to one of said scanning electrodes, a first switch connected between a first input terminal and said output terminal and a second switch connected between a second input terminal and said output terminal;

a scanning voltage circuit having a first line connected to each said first input terminal of said push/pull circuits, a second line connected to each said second input terminal of said push/pull circuits, a first scan switch for supplying a selected voltage to said first line via said first scan switch and a second scan switch for supplying an unselected voltage to said second line via said second scan switch;

a sustaining voltage circuit having a common line, a first sustaining switch for supplying a sustaining voltage to said common line via said first sustaining switch and a second sustaining switch for supplying a reference voltage to said common line via said second sustaining switch; and a separating circuit having a separating switch connected either between said first line and said common line or between said second line and said common line with the other being electrically continuous.

* * * * *